United States Patent [19]

Sasaki et al.

[11] Patent Number: 4,622,839

[45] Date of Patent: Nov. 18, 1986

[54] APPARATUS FOR MANUFACTURING SPRING UNIT

[75] Inventors: Noboru Sasaki; Yasuji Iwata; Teruo Mukai, all of Tokyo, Japan

[73] Assignee: France Bed Co., Ltd., Tokyo, Japan

[21] Appl. No.: 814,608

[22] Filed: Dec. 30, 1985

[30] Foreign Application Priority Data

Jan. 11, 1985 [JP] Japan ..... 60-2942
Jan. 11, 1985 [JP] Japan ..... 60-2943

[51] Int. Cl.[4] ..... B21F 3/12
[52] U.S. Cl. ..... 72/138; 140/71 R
[58] Field of Search ..... 72/137, 138, 142, 143, 72/144; 140/3 CA, 71 R, 102, 104, 105

[56] References Cited

U.S. PATENT DOCUMENTS

| | | | |
|---|---|---|---|
| 112,868 | 3/1871 | Van Vleck | 72/137 |
| 904,563 | 11/1908 | Rau | 140/71 R |
| 3,906,766 | 9/1975 | Sato | 72/12 |
| 3,937,256 | 2/1976 | Hamaguchi | 140/71 R |
| 3,993,106 | 11/1976 | Yokota | 140/71 R |
| 4,471,819 | 9/1984 | Nihashi | 140/71 R |

FOREIGN PATENT DOCUMENTS

| | | | |
|---|---|---|---|
| 356428 | 9/1931 | United Kingdom | 72/143 |

*Primary Examiner*—E. Michael Combs
*Attorney, Agent, or Firm*—Frishauf & Partners

[57] ABSTRACT

In an apparatus for manufacturing a spring unit, a pair of movable bodies are slidably mounted on a guide rail which is extended on a frame structure. A pair of rollers are provided on the respective movable bodies and a grip mechanism is arranged on the frame. The ends of a single wire are held between the pairs of rollers and the intermediate portion of the wire is gripped by a grip mechanism so that the single wire is stretched between the movable bodies. A swing arm is axially and swingably supported on each of the movable bodies and a forming roller is pivotably fixed to the respective swing arms. A guide is arranged between the forming rollers and the rollers and a pitch rod is arranged between the guide and the forming roller. When the swing arm is swung, the forming roller is abutted against the end of the wire and when the pair of movable bodies approach each other, the wire is extracted from the holding rollers and is abutted against the forming roller, thereby spirally forming the end of the wire with the forming roller.

7 Claims, 22 Drawing Figures

APPARATUS FOR MANUFACTURING SPRING UNIT

BACKGROUND OF THE INVENTION

The present invention relates to an apparatus for manufacturing a spring unit used in a mattress or a box spring mattress.

A spring or assembly structure for use in a box spring mattress is well known. In this conventional spring structure, a number of main spring units are arranged on a rectangular base. Each main spring unit is formed of a wire and has a straight section and a pair of spring sections having upper ends connected to the two ends of the straight section. The straight sections of the main spring units are assembled in a lattice form. The lower ends of the spring sections are fixed to the base. The straight sections of the main spring units in a lattice form are reinforced by intermediate support spring units. As in the main spring units, each intermediate support spring unit has a straight section and a pair of spring sections having upper ends connected to the two ends of the straight section. The upper ends of each intermediate support spring unit are also connected to the straight section of a main spring unit, with the lower ends fixed to the base.

In the spring assembly having the above structure, the spring sections with the main and intermediate support spring units comprise torsion bar spring sections. However, a torsion bar spring section is subject to a small amount of deformation when placed under a compression load. In other words, although the spring sections are stiff enough to securely support the body of a user, they are easily subject to permanent distortion upon repeated application of the compression load. Therefore, the spring assembly loses elasticity after only a short period of use.

In view of the above problem, it has been proposed to replace the spring sections of the spring assembly with coil spring sections. Since coil springs collapse less easily than torsion bar springs, the spring units can maintain elasticity over a longer period of time.

An apparatus for manufacturing a spring unit having coil spring sections at two ends of a straight section from a single wire has been proposed in U.S. Ser. No. 626,435, filed June 29, 1984. Although this apparatus is suitable for mass production of spring units, it has a large number of steps for forming a single wire into a spring unit. Therefore, an apparatus which can manufacture a spring unit with simplified steps is desirable.

SUMMARY OF THE INVENTION

It is an object of the present invention to provide an apparatus which can manufacture a spring unit from a single wire in a continuous process.

According to the present invention, there is provided an apparatus for manufacturing a spring unit, comprising:

a frame structure;

a guide rail extending on the frame structure;

a pair of movable bodies which are arranged at a specific distance from each other on the guide rail, so as to travel thereon;

means, arranged on the pair of movable bodies, for respectively holding two ends of a single wire;

grip means, arranged on the frame structure, for gripping an intermediate portion of the single wire held by the holding means, so as to prevent the wire from sliding along a longitudinal direction thereof;

a swing arm, axially and swingably supported on each of the movable bodies;

forming rollers pivotably fixed to the swing arms to perform a swinging movement therewith, the forming rollers upon the swinging movement to abut against the ends of the single wire which extend from corresponding holding means, thereby bending the ends of the single wire, which, after the swinging movement of the forming rollers and while the pair of movable bodies approach each other, continues to extend from the holding means and abut against the forming rollers, thereby spirally forming the ends of the single wire with the forming rollers;

guide means, interposed between the forming rollers and the holding means, for guiding the single wire extending from the holding means toward the forming rollers, a diameter of a coil of the wire being determined by a distance between the guide means and the forming rollers; and a pitch rod, interposed between the guide means and the forming rollers, for determining the pitch of coils formed by the guide means and the forming rollers.

DETAILED DESCRIPTION OF THE PREFERRED EMBODIMENT

Figure 1:
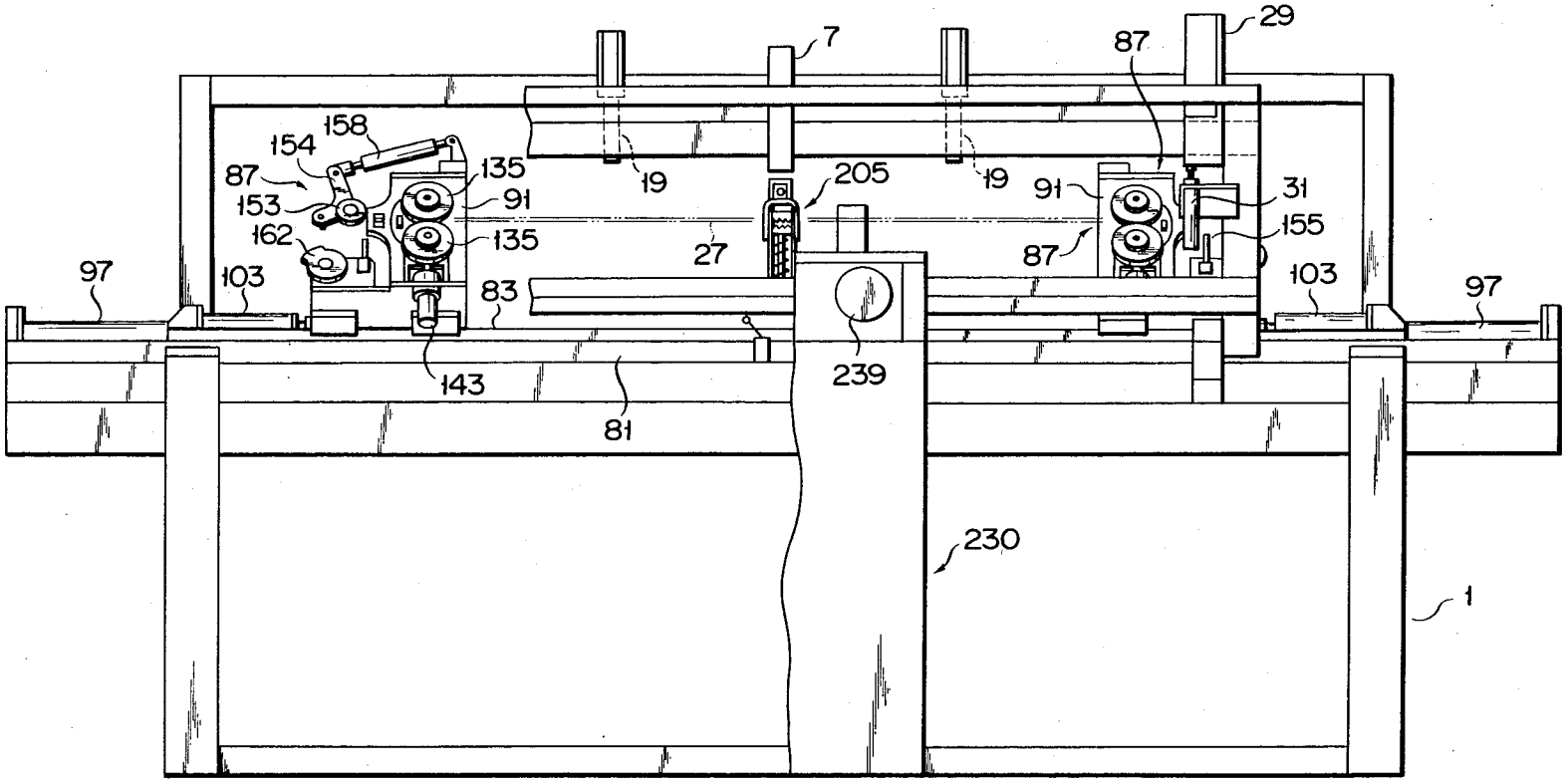
FIG. 1 is a front view of an apparatus for forming a coil spring section from a single wire, according to an embodiment of the present invention.
Figure 2:
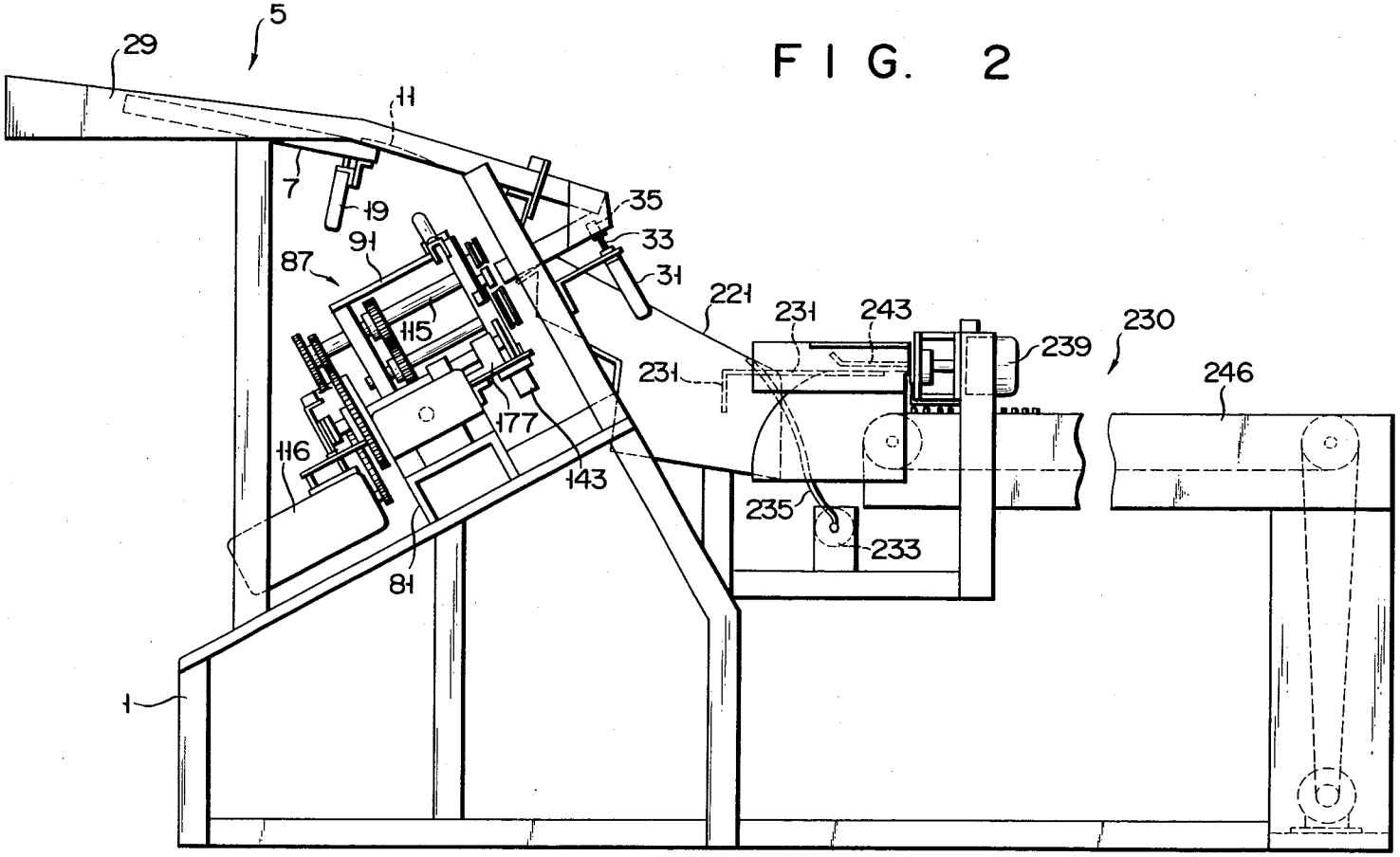
FIG. 2 is a side view of the apparatus in FIG. 1.
Figure 3:
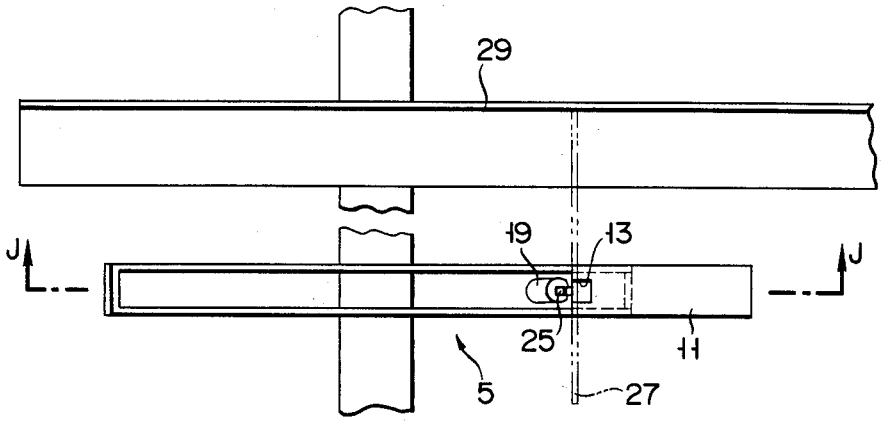
FIG. 3 is a plan view of a stacking section of the apparatus in FIG. 1.
Figure 4:
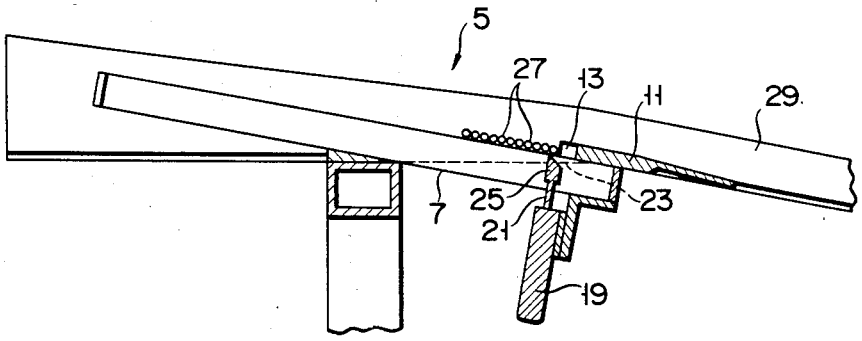
FIG. 4 is a sectional view of the apparatus in FIG. 3 along the line J—J therein.

A spring manufacturing apparatus shown in FIGS. 1 and 2 has main body or base frame 1. Stacking section 5 is arranged on the upper surface of main body 1, as shown in FIGS. 2 to 4. Section 5 stacks a number of wires. A plurality of stack members 7 are arranged at the upper surface of main body 1 and are inclined from the rear side to the front side of body 1. One end of receiver plate 11 is fixed to the upper surfaces of the distal ends of two end stack members 7 along the longitudinal direction of body 1, as shown in FIGS. 3 and 4. Notches 13 are formed in plate 11 and projecting cylinders 19 are arranged therebelow. Rod 21 of each cylinder 19 has press body 25 with tapered surface 23. A number of wires 27 of predetermined length are placed on stack members 7 such that they can roll. End wire 27 is in contact with the end face of plate 11.

Figure 10:
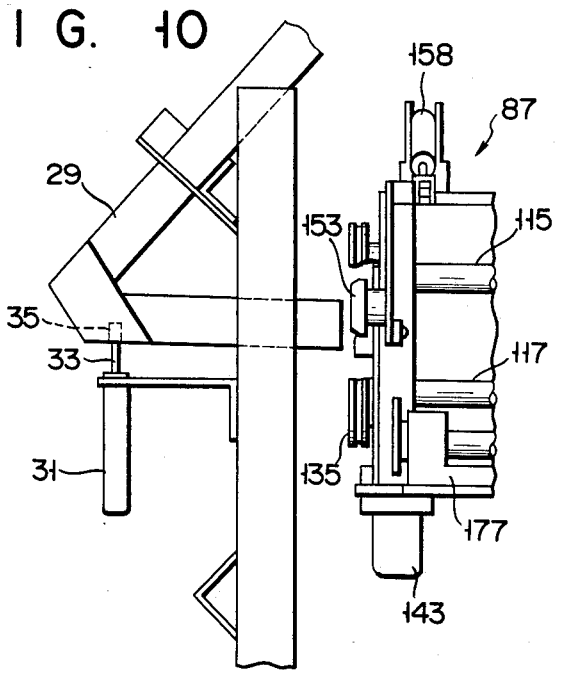
FIG. 10 is a side view of a distal end portion of a guide plate shown in FIG. 2.
Figure 11:
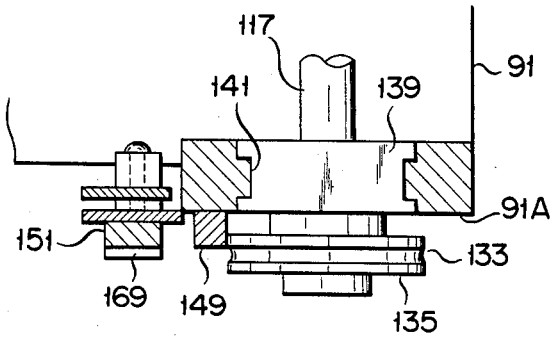
FIG. 11 is a sectional view of a mount structure of a holding roller shown in FIG. 1.

When cylinders 19 are actuated and rods 21 are moved upward, end wire 27 is released from contact with the end face of plate 11 and rolls thereon. L-shaped guide plates 29 are arranged outside end stack members 7 so as to regulate the rolling direction of wire 27, as shown in FIG. 4. The distal ends of plates 29 extending from the front end of main body 1 are bent in a substantially V-shape as shown in FIG. 2. The bent ends are fixed to the inclined front frame of body 1, and extend to the front surfaces of movable bodies 87, to be described later. Stop cylinders 31 are arranged at the bent distal ends of guide plates 29, as shown in FIGS. 2 and 10. Stoppers 35 are fixed to rods 33 of cylinders 31, and temporarily stop wire 27 which has been supplied from plate 11 through guide plates 29. When cylinders 31 are actuated to withdraw rods 33, stoppers 35 are disengaged from wire 27. Wire 27 is then guided by guide plates 29 and supplied to movable bodies 87.

Figure 5:
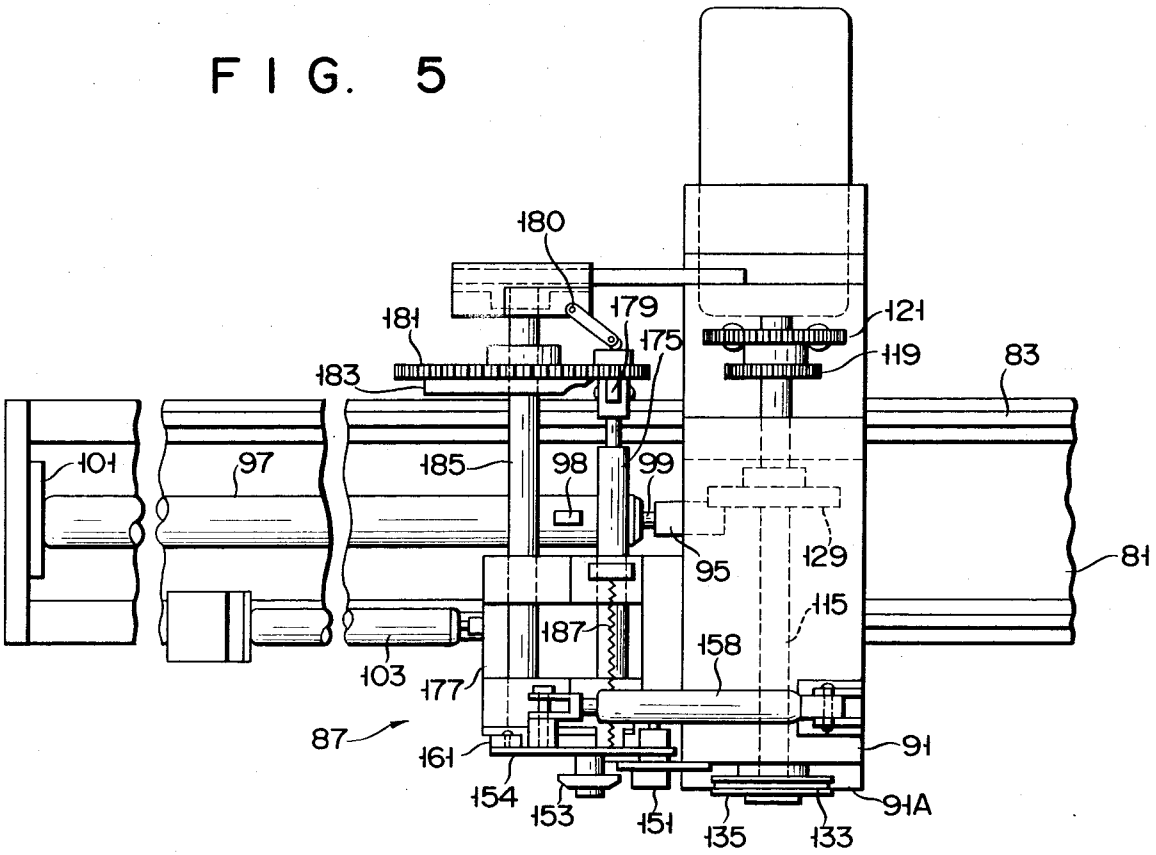
FIG. 5 is a plan view of movable bodies of the apparatus in FIG. 1.
Figure 6:
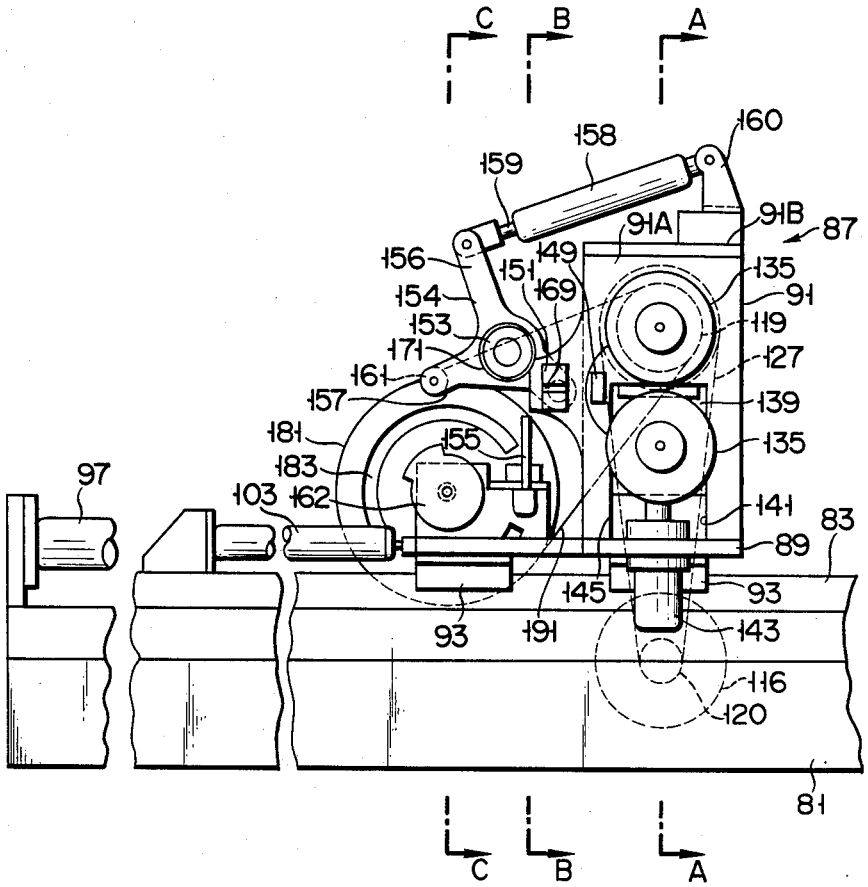
FIG. 6 is a side view of a movable body.

Channel-like lateral member 81 extends along the longitudinal direction of the inclined upper frame of main body 1, as shown in FIGS. 1 and 2. A pair of parallel guide rails 83 are arranged on member 81. Paired movable bodies 87 are movable along guide rails 83. As shown in FIG. 6, each movable body 87 is comprised of base 89 with upper housing 91 thereon. Receptacles 93 are formed on the lower surface of each base 89 and slidably engage with corresponding guide rail 83, as shown in FIGS. 6 to 9. Coupling members 95 are arranged on the upper surface of main body 1 so as to be above bases 89, as shown in FIG. 5. Rods 99 of drive cylinders 97, arranged on the upper surface of lateral member 81, are coupled to members 95. Drive cylinder 97 is fixed to corresponding mount member 101 at each end of lateral member 81.

When movable bodies 87 move to approach each other along guide rails 83, rods 99 of cylinders 97 project. When rods 99 project a predetermined distance, they are detected by lead switches 98 on cylinders 97, as shown in FIG. 5. Rods 99 are then driven by cylinders 97 to withdraw, and movable bodies 87 are moved to separate from each other. When bodies 87 return to the initial position, the ends of bases 89 abut against buffer members 103 on lateral member 81, as shown in FIGS. 5 and 6. Movable bodies 87 are thus stopped and kept at a predetermined distance from each other in the initial position.

Figure 7:
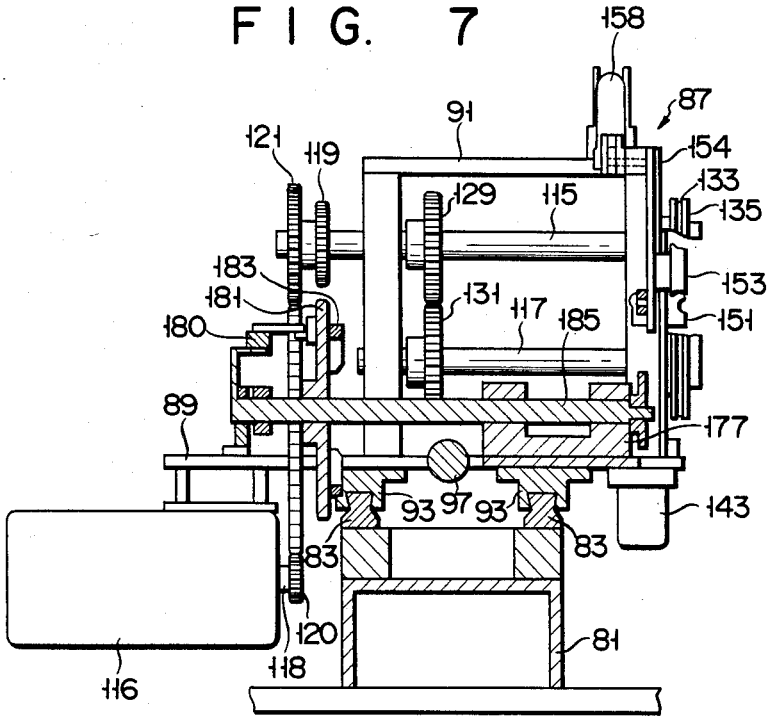
FIG. 7 is a sectional view of the movable body in FIG. 6 along the line C—C therein.
Figure 8:
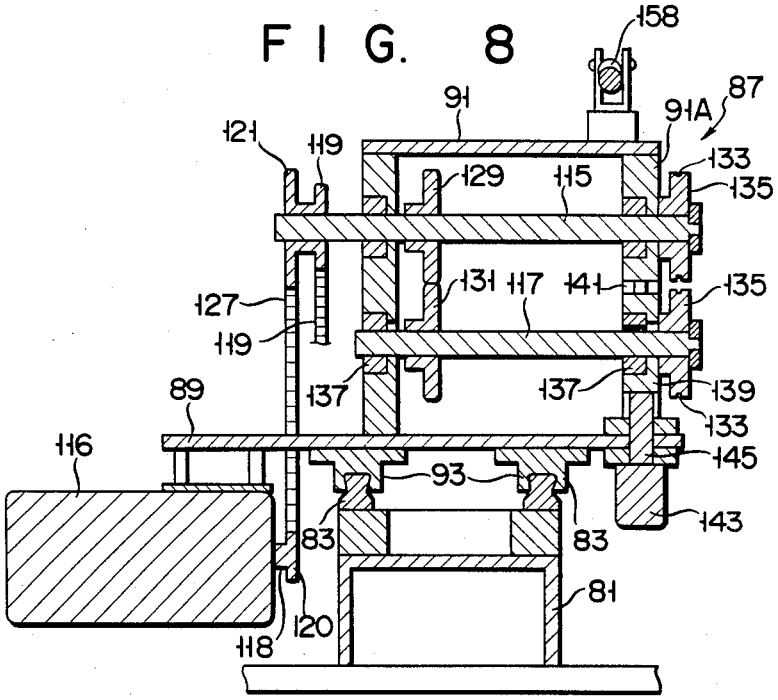
FIG. 8 is a sectional view of the movable body in FIG. 6 along the line A—A therein.

In each body 87, first and second pivot shafts 115 and 117 rotatably extend from the rear to the front side of upper housing 91, as shown in FIGS. 7 and 8. First and second sprockets 119 and 121 are fitted around one end of shaft 115, extending externally from the rear side of housing 91. Third sprocket 120 is fitted around rotating shaft 118 of drive motor 116. First and second gears 129 and 131 mesh together and are fitted around an intermediate portion between shafts 115 and 117. Holding rollers 135 are fitted around the ends of shafts 115 and 117, which extend toward the front side of housing 91.

Rollers 135 have grooves 133 formed in their circumferential surfaces, as shown in FIG. 8, and are vertically separated from each other by a distance larger than the diameter of wires 27. When the end of shaft 117 mounting lower roller 135 is moved upward, the distance between rollers 135 is decreased. The two ends of shaft 117 are swingably supported on housing 91 by automatic indexing bearings 137. One bearing 137 supporting the end of shaft 117 mounting roller 135 is held by slide body 139. Slide body 139 is slidably inserted in vertical slide groove 141 formed in front plate 91A of housing 91. Press cylinder 143 is arranged at the lower end of slide groove 141, as shown in FIGS. 7 and 8.

Rod 145 of cylinder 143 is coupled to slide body 139. When cylinder 143 is actuated and rod 145 projects, slide body 139 is moved upward to swing second pivot shaft 117. Cylinder 143 is actuated after stop cylinder 31 (FIG. 2) is actuated. More specifically, after stop cylinder 31 is actuated and wire 27 is guided by guide plates 29, the ends of wire 27 are inserted between paired rollers 135 of separated movable bodies 87. Next, cylinders 143 (FIGS. 7 and 8) are actuated to move lower holding rollers 135 so that the ends of wire 27 are held by rollers 135, and are not removed from grooves 133. At this time, as shown in FIGS. 7 and 8, gears 129 and 131 mesh together.

Magnet 149 and guide body 151 are arranged on front plate 91A of housing 91, as shown in FIG. 6. Mount member 154 mounts forming roller 153 and is pivotally mounted on front plate 91A at the rear side of guide plate 151. Pitch rod 155 is arranged between guide body 151 and forming roller 153, as shown in FIG. 6. Magnet 149 attracts an end of wire 27, held between paired rollers 135, so as to prevent the end from deviating from plate 91A. Insertion groove 169 is formed in guide body 151. When wire 27 is supplied between paired rollers 135, the ends of wires 27 are inserted in corresponding insertion grooves 169.

Figure 18:
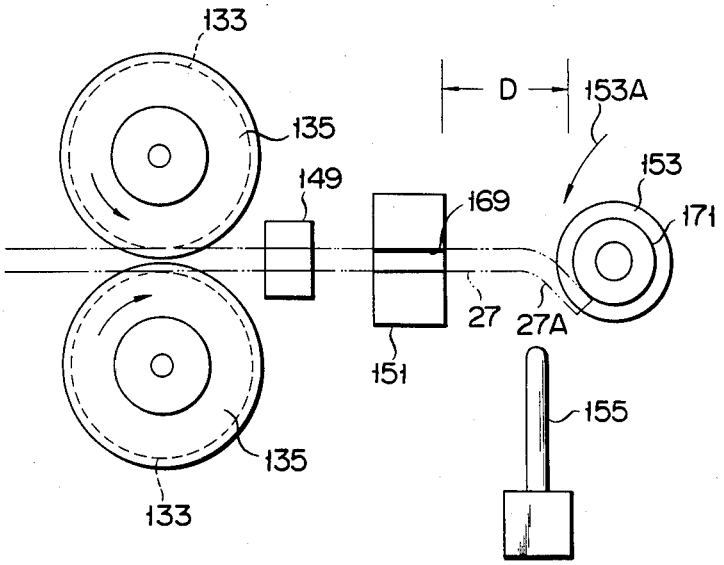
FIG. 18 is an enlarged diagram for explaining the front portion of the movable body.
Figure 19:
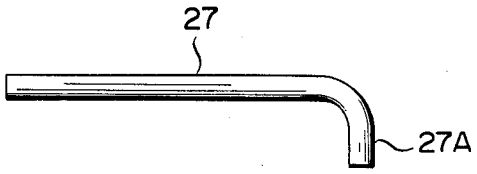
FIG. 19 is a plan view showing a bent section formed at an end of a wire.

Guide surface 171 is formed in each forming roller 153, as shown in FIGS. 6 and 18. A pair of arms 156 and 157 are mounted on mount member 154 of roller 153. Rod 159 of cylinder 158 is pivotally mounted on one arm 156. Cylinder 158 is also pivotally mounted on support pieces 160 on upper plate 91B of housing 91. Cam follower 161 is rotatably mounted on arm 157. Cam 162 is mounted on base 89 such that its angle can be adjusted. When mount member 154 is pivoted around the pivot point of front plate 91A by cylinder 158, cam follower 161 abuts against cam 162 and regulates the rotating range or angle of member 154. Therefore, when member 154 is rotated, forming roller 153 is shifted in a direction indicated by arrow 153A in FIG. 18. Roller 153 is then abutted against the corresponding end of wire 27 extending from guide body 151, to form downward bent section 27A, as shown in FIG. 19.

Figure 9:
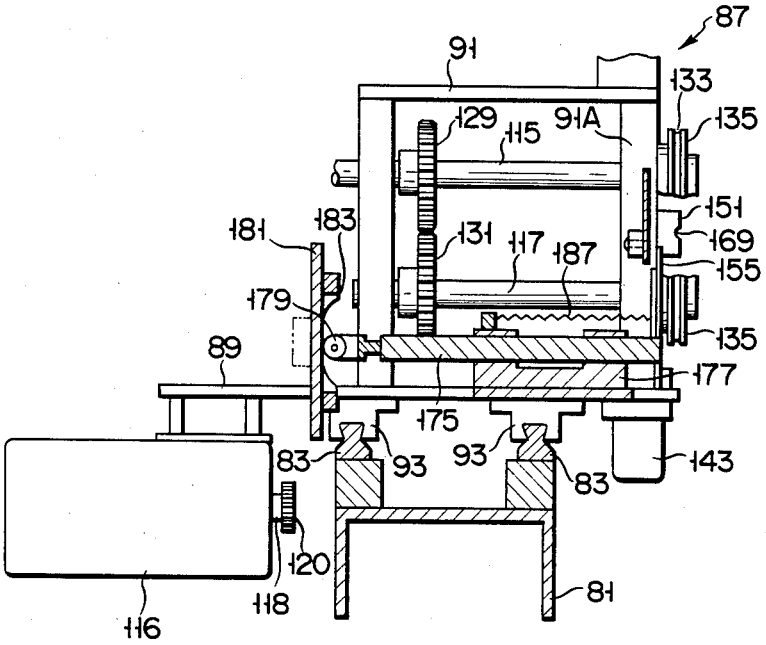
FIG. 9 is a sectional view of the movable body in FIG. 6 along the line B—B therein.

Pitch rod 155 is arranged at one end of projecting shaft 175, as shown in FIG. 9. Shaft 175 has a rectangular section and is slidably supported by receptacle 177 in housing 91. Cam follower 179 is arranged at the other end of shaft 175. Cam follower 179 abuts against cam surface 183, formed in one surface of fourth sprocket 181. Third pivot shaft 185 is pivotally supported on receptacle 177 and fourth sprocket 181 is fitted around shaft 185, as shown in FIG. 7. As shown in FIG. 9, tension spring 187 is mounted between one end of shaft 175 and receptacle 177. Spring 187 urges cam follower 179 against cam surface 183 of sprocket 181.

Second chain 191 is mounted between fourth and first sprockets 181 and 119, as shown in FIG. 6. When drive motor 116 is energized and first pivot shaft 115 is rotated, chain 191 is also rotated. The gear ratio of second and third sprockets 121 and 120 is determined such that third pivot shaft 185 and hence fourth sprocket 181 rotate once while coils 27B (shown in FIG. 20) are formed at an end of wire 27. When sprocket 181 rotates once, it is detected by limit switch 180, shown in FIG. 7.

Figure 12:
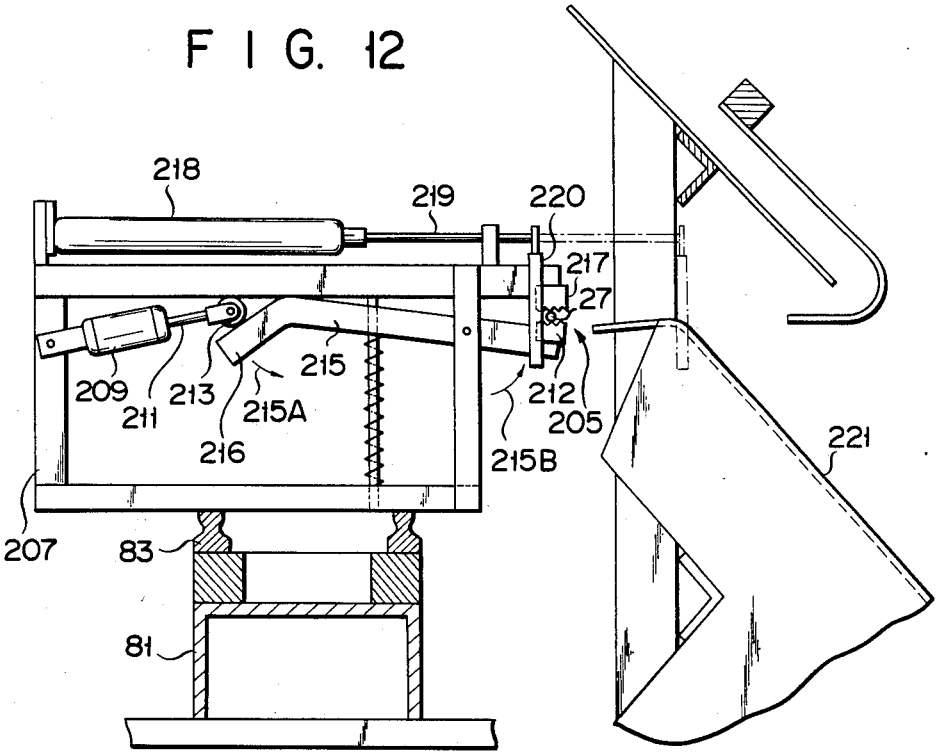
FIG. 12 is a side view of a clamping mechanism shown in FIG. 1.

As shown in FIG. 1, clamping mechanism 205 is arranged at the center (along the longitudinal direction) of the front side of main body 1. Mechanism 205 has support frame 207 having its lower end fixed to guide rails 83, as shown in FIG. 12. One end of clamp cylinder 209 is pivotally mounted on frame 207, and roller 213 is mounted on rod 211 of cylinder 209. An intermediate portion of movable arm 215 is pivotally supported on the upper portion of frame 207. Bent portion 216 is formed at the rear end of arm 215. Roller 213 is interposed between bent portion 216 and the lower ceiling surface of frame 207.

Fixed clamping portion 217 is arranged at the distal end of frame 207 so as to oppose movable clamping portion 212. When clamp cylinder 209 is actuated and rod 211 projects, movable arm 215 is pivoted by roller 213 in directions indicated by arrows 215A and 215B, and movable portion 212 is moved to engage with fixed portion 217. Portions 212 and 217 clamp an intermediate portion of wire 27, which has ends supported by holding rollers 135 of movable bodies 87. Axial movement of wire 27 is thus prevented. When roller 213 is withdrawn, arm 215 is moved in the direction opposite to that indicated by the arrows in FIG. 12.

Figure 21:
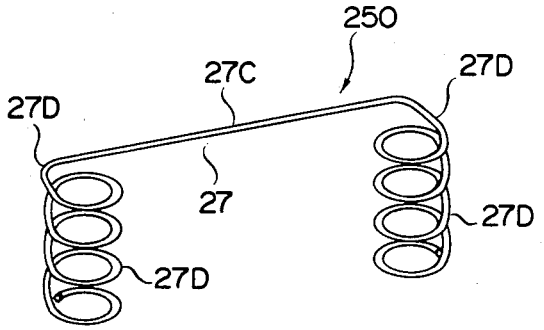
FIG. 21 is a perspective view showing coils formed at the two ends of a straight section of the spring in FIG. 20.
Figure 22:
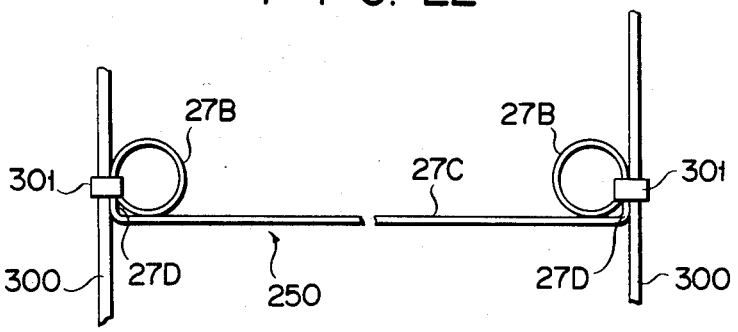
FIG. 22 is a plan view of the springs connected with a frame wire.

Pickup cylinder 218 is arranged on the upper surface of frame 207 with press member 220 mounted on rod 219 of cylinder 218. After coils 27B are formed at the two ends of wire 27, cylinder 218 is actuated and pushes wire 27 to the front side of body 1. Downwardly inclined receiver plate 221 is arranged at the central portion of the front side of main body 1, as shown in FIGS. 2 and 12. Wire 27 pushed by cylinder 218 is dropped on plate 221 and is received by bending unit 230. Unit 230 forms right-angled bent sections 27D at the ends of straight section 27C connected to coils 27B of wire 27, as shown in FIG. 21.

Unit 230 has a configuration as shown in FIGS. 13 to 17. Unit 230 has a pair of guide rods 231 for receiving straight section 27C of wire 27 dropped on plate 221. Rods 231 are parallel to each other and are spaced apart by a distance smaller than that between coils 27B at the ends of wire 27. A pair of parallel side guide plates 232 outside guide rods 231 receive coils 28B at the ends of wire 27. The distal ends of guide plates 232 extend further than those of guide rods 231. Feed rotation cylinder 233 is arranged below and between guide plates 232. One end of feed plate 235 is fixed to rod 234 of cylinder 233. The other end of feed plate 235 projects upward at the rear side of guide plates 232. When wire 27 is placed on guide rods 231 and feed plate 235 is rotated from the state shown in FIG. 14 to that shown in FIG. 15, in the direction indicated by the arrow, the other end of feed plate 235 engages with straight section 27C of wire 27. Next, wire 27 is conveyed by feed plate 235 on guide rods 231 and plates 232. During this convey operation, coils 27B formed at the two ends of wire 27 ride over plates 232, and the axial direction of wire 27 is changed from a vertical to a horizontal direction.

Figure 13:
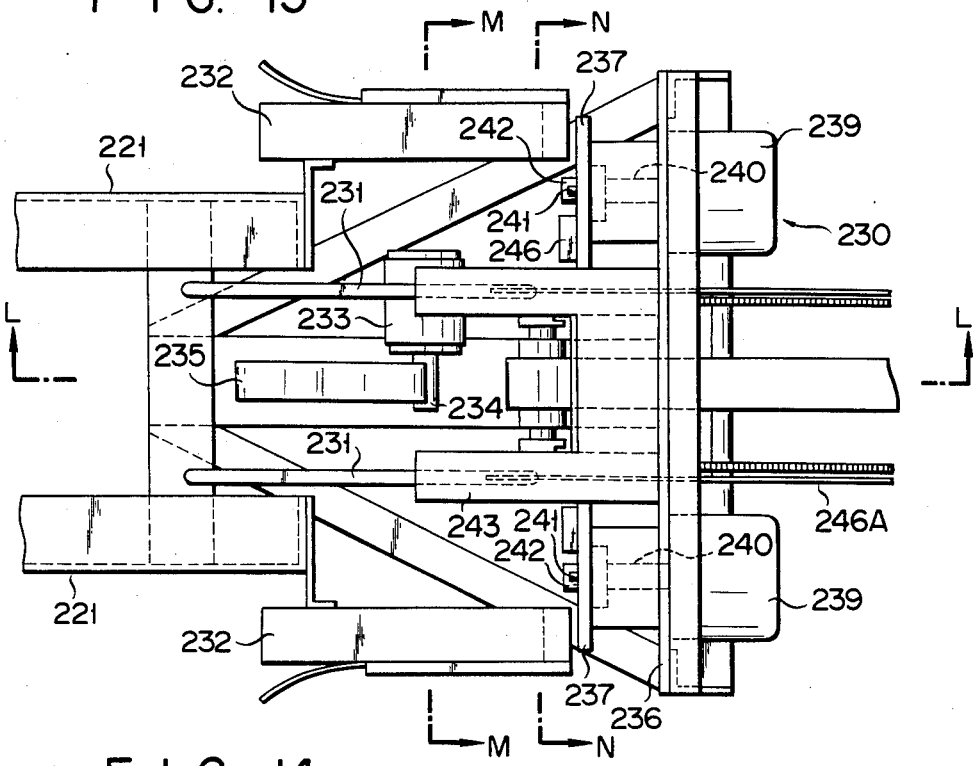
FIG. 13 is a plan view of a bending unit shown in FIG. 2.
Figure 14:
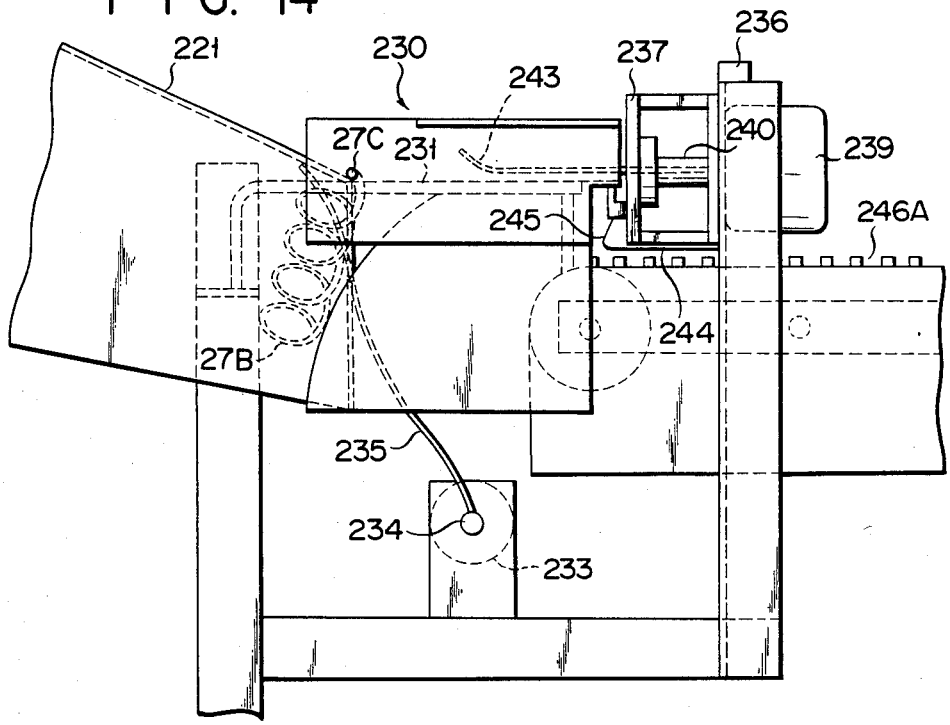
FIG. 14 is a side view of the bending unit shown in FIG. 13.
Figure 16:
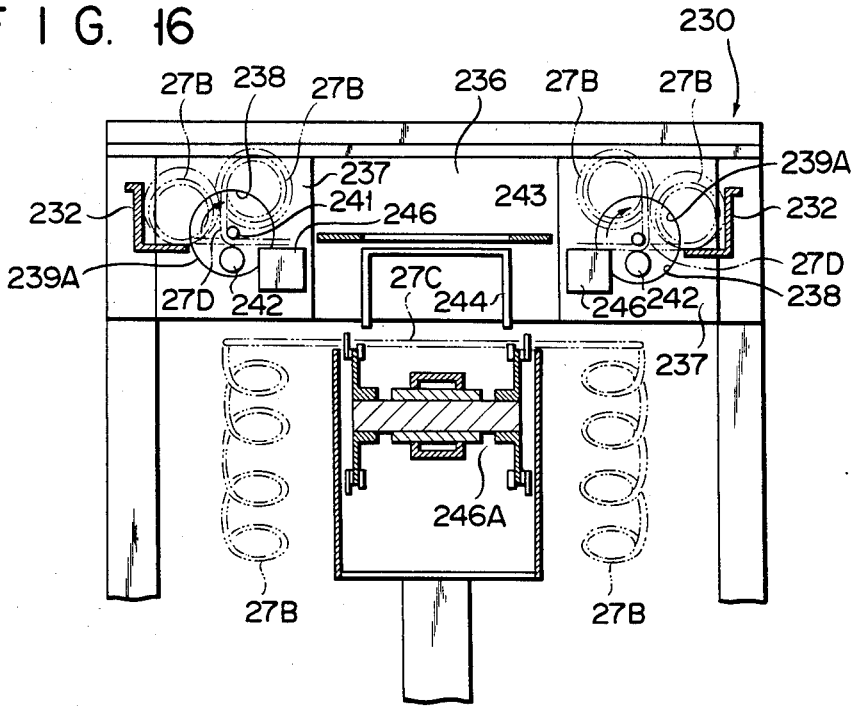
FIG. 16 is a sectional view of the unit in FIG. 13 along the line N—N therein.
Figure 17:
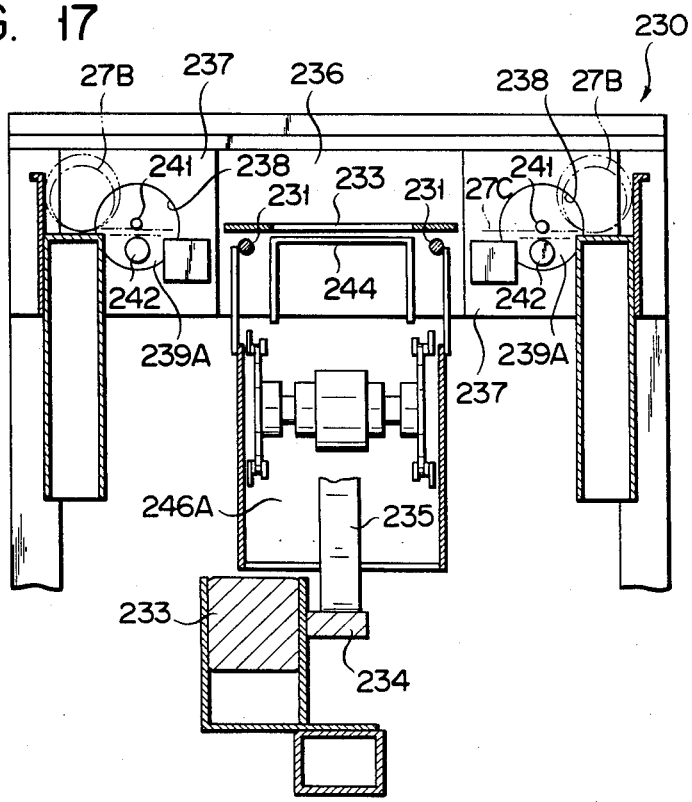
FIG. 17 is a sectional view of the unit in FIG. 13 along the line M—M therein.

Mount plate 236 is arranged at the distal ends of plates 232 at right angles thereto. Rectangular abutment plates 237 are arranged at either end of one side of plate 236 which opposes the distal ends of plates 232. As shown in FIGS. 16 and 17, circular holes 238 are formed in abutment plates 237 so as to rotatably receive rotation plates 239A. Plates 239A are mounted on rods 240 of rotation cylinders 239 at the rear side of mount plate 236, as shown in FIGS. 13 and 14. Center pins 241 project on rotation plates 239A, with bending rollers 242 separated from pins 241 and at eccentric positions thereon, as shown in FIGS. 16 and 17. When wire 27 is fed onto guide plates 232 by feed plate 235, the ends of straight section 27C are sandwiched between pins 241 and rollers 242. Rotation plates 239A are then pivoted through 90 degrees along the direction indicated by the arrow in FIG. 16, and bent sections 27D are formed at right angles to the ends of straight section 27C.

Figure 15:
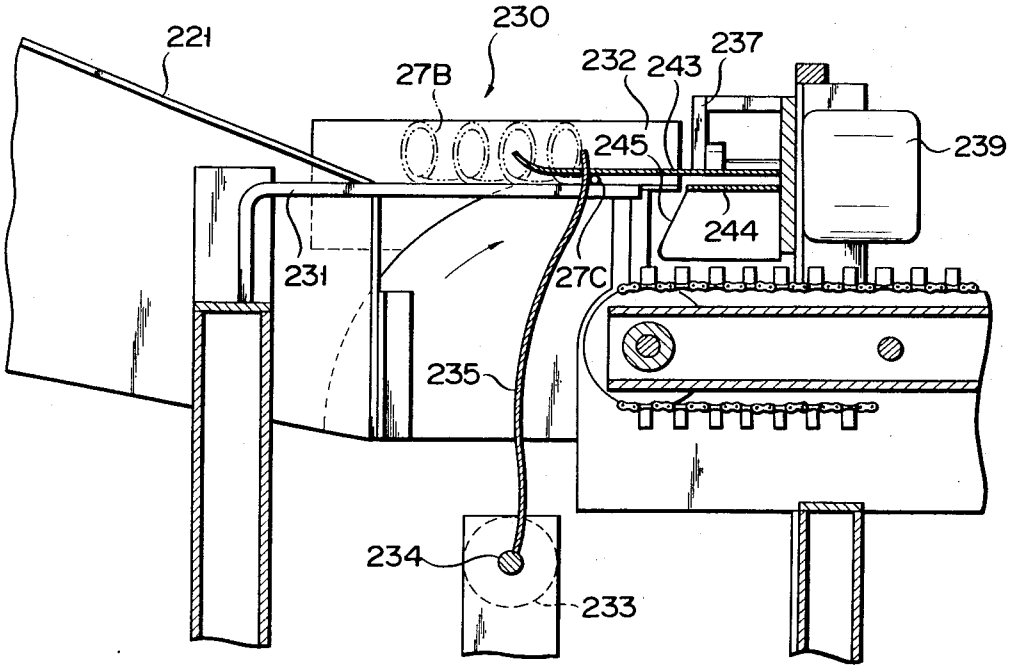
FIG. 15 is a sectional view of the unit in FIG. 13 along the line L—L therein.

Upon formation of sections 27D, coils 27B are removed from plates 232 and shifted inward, as indicated by the alternate long and two short dashed lines in FIG. 16. When plate 235 returns to the predetermined initial position upon formation of sections 27D and wire 27 is removed from plate 235, wire 27 is dropped, as will be described later. Upper and lower guide plates 243 and 244 are mounted at the central portion of plate 236 along its longitudinal direction. Plate 243 has its distal end separated from guide rods 231 and extends to oppose them. Plate 244 is separated from the lower surface of the proximal end of plate 243 and opposes it. The distal end of plate 244 extends to a position equivalent to the end face of abutment plates 237 and its distal end face constitutes inclined surface 245, as shown in FIGS. 14 and 15. Therefore, when wire 27 drops, it is along inclined surface 245.

Press plates 246 are arranged at positions on guide plates 237 which receive the ends of straight section 27C of wire 27 which are sandwiched between pins 241 and rollers 242. Press plates 246 serve to prevent downward flexure of straight section 27C and allow reliable formation of bent sections 27D, as shown in FIGS. 16 and 17.

Conveyor 246A is arranged below guide plates 237 and receives and conveys straight section 27C of wire 27 dropping from rotation plates 239A via inclined surface 245.

The manufacture of the spring unit by the above apparatus will now be described. When the start switch of a control panel (not shown) is turned on, projecting cylinders 19 are actuated to pick up one wire 27 from stacking section 5. Wire 27 rolls on receiver plate 11 and abuts against stoppers 35 of stopping cylinders 31. Next, cylinders 31 are actuated and wire 27 is disengaged. Wire 27 is then supplied to the pair of movable bodies 87. The ends of wire 27 are inserted between paired holding rollers 135. Alternatively, cylinders 31 are actuated upon turning on of the start switch. If wire 27 is stopped by stoppers 35 upon turning on of the start switch, wire 27 is supplied to movable bodies 87.

When wire 27 is supplied to movable bodies 87, press cylinders 143 and clamp cylinders 209 are actuated. When cylinders 143 are actuated, the ends of wire 27 are clamped by paired holding rollers 135. When cylinders 209 are actuated, movable arms 215 are pivoted and the intermediate portion of wire 27 is clamped between movable and fixed clamping portions 212 and 217, so that axial slide movement of wire 27 is prevented. When wire 27 is held and fixed in position in this manner, cylinders 158 mounted on movable bodies 87 are actuated and pivot mount members 154. Forming rollers 153 mounted on members 154 bend the ends of wire 27 projecting from guide bodies 151 into bent sections 27A. Cylinders 158 are then actuated in the reverse direction to return mount members 154 to the initial position. At the same time, drive motor 116 is driven and rollers 135 are driven in the direction indicated by the arrow in FIG. 18. Rollers 135 then feed wire 27 through the gaps between rollers 135. More specifically, the pair of movable bodies 87 are driven to approach each other from the separated state shown in FIG. 1. Bent sections 27A at the ends of wire 27 are abutted against the outer circumferential surfaces of forming rollers 153 and are formed into coils 27B. During this period, since bent sections 27A are directed downward, the ends of wire 27 are bent downward. The diameter of each coil is determined by distance D between guide body 151 and roller 153, as shown in FIG. 18. When one coil is formed at each end of wire 27, pitch rods 155 project from plates 91A of housing 91 and push coils just formed in an upward direction.

Figure 20:
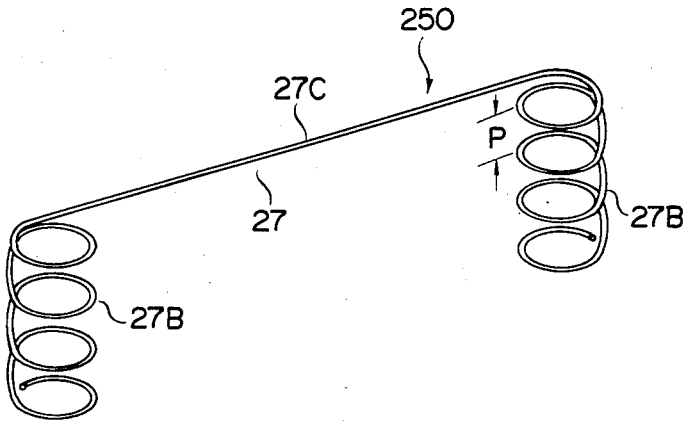
FIG. 20 is a perspective view showing a wire formed into a spring.

As movable bodies 87 move further, fourth sprockets 181 having cam surfaces 183 rotate with third pivot shafts 185. Cam followers 179 abutting against cam surfaces 183 move from a bottom dead point to a top dead point, projecting shafts 175 are displaced, and pitch rods 155 project. Upon further movement of bodies 87, further coils are formed at each end of wire 27, at pitch P which corresponds to the projection amount of pitch rods 155, shown in FIG. 20. Thus, when bodies 87 move a predetermined distance, rods 99 of drive cylinders 97 project a predetermined length. When lead switches 98 detect this, they produce detection signals which stop movable bodies 87. In this manner, a predetermined number of coils 27B are formed at ends of wire 27. In this manner, wire 27 is formed into spring 250, which has straight section 27C and coils 28B having upper ends connected to the two ends of straight section 27C, as shown in FIG. 20.

When coils 27B are formed in this manner, cylinders 143 and 209 are actuated in the reverse direction, and spring 250 is released. Pickup cylinders 218 are then actuated, and press members 220 on rods 219 drop spring 250 onto plate 221. Spring 250 is then placed on rods 231 of unit 230. Next, feed rotation cylinder 233 is actuated and feed plate 235 is pivoted. Plate 235 feeds spring 250 along rods 231 and plates 232. Coils 27B of spring 250 ride over plates 232 and spring 250 is pivoted to a horizontal orientation. Thereafter, ends of straight section 27C are inserted between center pins 241 and bending rollers 242 on rotation plates 239A. Rotation cylinders 239 are then actuated and plates 239A are rotated about 90 degrees. The ends of straight section 27C are thus bent at about right angles to form bent portions 27D. Bent portions 27D are used for connecting spring 250 to frame wires 300 with clips 301. In other words, when a number of springs 250 are arranged in a lattice form to obtain a spring unit, frame wires 300 are arranged to surround the spring unit. In this manner, since frame wires 300 and bent portions 27D in linear contact are coupled by clips 301, they are secure.

When bent sections 27D are formed at the two ends of straight section 27C of spring 250, cylinders 233 are pivoted in the reverse direction and abutment between plate 235 and spring 250 is released. Spring 250 drops onto conveyor 246 from plates 239 via inclined surface 245 and is conveyed to a suitable position.

According to the present invention, springs each having a straight section and coils formed at the two ends of the straight section can be mass-produced from a single wire. In addition, when coils are formed at the ends of the wire, the intermediate portion of the wire is clamped by the claming mechanism and its axial movement is prevented. Therefore, coils can be formed reliably and symmetrically. In addition, since bent sections are formed at the ends of the straight section of the wire before coils are formed, the coils can be formed in predetermined directions. Since forming rollers are used to form bent sections, the structure of the apparatus for forming such sections can be simplified.

What is claimed is:

1. An apparatus for manufacturing a spring unit, comprising:

a frame structure;

a guide rail extending on said frame structure;

a pair of movable bodies which are arranged at a predetermined distance from each other on said guide rail so as to travel thereon;

means for driving said bodies along said guide rail;

means, arranged on said pair of movable bodies, for respectively holding two ends of a single wire;

grip means, arranged on said frame structure, for gripping an intermediate portion of the single wire held by said holding means so as to prevent the wire from sliding along a longitudinal direction thereof;

a swing arm, axially and swingably supported on each of said movable bodies;

forming rollers pivotably fixed to said swing arms to perform a swinging movement therewith, said forming rollers upon the swinging movement being abuted against the ends of the single wire which extend from corresponding holding means, thereby bending the ends of the single wire, after the swinging movement of said forming rollers and while said pair of movable bodies approach each other, the wire end being extended from said holding means and being abuted against said forming rollers, thereby spirally forming the ends of the single wire with said forming rollers;

guide means, interposed between said forming rollers and said holding means, for guiding the single wire extending from said holding means toward said forming rollers, a diameter of a coil of the wire being determined by a distance between said guide means and said forming rollers; and a pitch rod, interposed between said guide means and said forming rollers, for determining a pitch of coils formed by said guide means and said forming rollers.

2. An apparatus according to claim 1, further comprising:

a receiver plate for receiving the wire on which coils are formed at the ends of a straight section of the wire and released from said holding means; and bending means for bending the ends of the straight section of the wire supplied through said receiver plate at substantially right angles.

3. An apparatus according to claim 1, further comprising:

a stacking section, arranged on said frame structure, for stacking a number of single wires; and means for picking up single wires one by one from said stacking section and for supplying the picked up wire to a space between a pair of holding means.

4. An apparatus according to claim 1, further comprising:

means for variably adjusting a swing range of said swing arm.

5. An apparatus according to claim 1, wherein said holding means comprises:

a pair of holding rollers; and a roller slide mechanism for slidably holding one of said pair of holding rollers so as to clamp the single wire between said pair of holding rollers.

6. An apparatus according to claim 1, further comprising:

means for pulling the single wire, said pair of movable bodies thereupon being moved to approach each other along said guide rail.

7. An apparatus according to claim 1, further comprising:

a magnet, arranged for each of said pair of movable bodies, for attracting the single wire.

* * * * *